US008424417B1

(12) United States Patent
Ostroff

(10) Patent No.: US 8,424,417 B1
(45) Date of Patent: Apr. 23, 2013

(54) GRIPPER FOR OPENING LUMEN AND VIAL CLOSURES

(76) Inventor: Matthew Ostroff, Emerson, NJ (US)

( * ) Notice: Subject to any disclaimer, the term of this patent is extended or adjusted under 35 U.S.C. 154(b) by 264 days.

(21) Appl. No.: 12/982,466

(22) Filed: Dec. 30, 2010

(51) Int. Cl.
*B67B 7/14* (2006.01)

(52) U.S. Cl.
USPC ..... 81/3.4; 81/64

(58) Field of Classification Search ..... 81/3.4, 81/3.41, 64; 428/98, 119, 120; 2/163
See application file for complete search history.

(56) References Cited

U.S. PATENT DOCUMENTS

| | | | | | |
|---|---|---|---|---|---|
| 1,887,152 | A | * | 11/1932 | Geisler | 81/3.4 |
| 2,054,768 | A | * | 9/1936 | Gale, Jr. | 602/59 |
| 2,748,766 | A | * | 6/1956 | Coates | 602/58 |
| 3,728,916 | A | | 4/1973 | Brantley | |
| 3,888,244 | A | * | 6/1975 | Lebold | 602/4 |
| 3,989,041 | A | * | 11/1976 | Davies | 602/62 |
| 4,010,662 | A | * | 3/1977 | Perrault | 81/64 |
| 4,149,534 | A | * | 4/1979 | Tenczar | 604/403 |
| 4,154,245 | A | * | 5/1979 | Daily | 607/105 |
| 4,281,647 | A | * | 8/1981 | Antypas | 602/21 |
| D275,442 | S | * | 9/1984 | Hayes | D8/18 |
| 4,532,833 | A | | 8/1985 | Downs | |
| 4,827,973 | A | * | 5/1989 | Boehmer | 137/512.15 |
| 4,860,617 | A | | 8/1989 | Robbins | |
| 4,985,018 | A | | 1/1991 | Smith | |
| 5,062,625 | A | * | 11/1991 | Vonk | 482/48 |
| 5,158,553 | A | | 10/1992 | Berry et al. | |
| 5,389,082 | A | | 2/1995 | Baugues et al. | |
| 5,458,027 | A | | 10/1995 | Rambin | |
| 5,479,660 | A | * | 1/1996 | Najac | 2/20 |
| 5,538,500 | A | * | 7/1996 | Peterson | 602/48 |
| 5,704,258 | A | | 1/1998 | LaVoie | |
| 5,770,297 | A | * | 6/1998 | Grubich | 428/99 |
| 6,402,712 | B1 | * | 6/2002 | Gauvry | 602/26 |
| 6,447,470 | B2 | * | 9/2002 | Bodenschatz et al. | 602/75 |
| 6,834,397 | B1 | * | 12/2004 | Murphy | 2/161.1 |
| 2002/0189408 | A1 | * | 12/2002 | McCabe et al. | 81/64 |
| 2006/0005296 | A1 | * | 1/2006 | Moore | 2/159 |
| 2006/0289011 | A1 | * | 12/2006 | Helsel | 128/207.17 |
| 2009/0076417 | A1 | * | 3/2009 | Jones | 600/585 |

* cited by examiner

*Primary Examiner* — David B Thomas
(74) *Attorney, Agent, or Firm* — Goldstein Law Offices, P.C.

(57) ABSTRACT

A gripper having a pair of straps for safely opening a narrow cylindrical article, by wrapping a closure on a narrow cylindrical article with a first strap and wrapping the narrow cylindrical article with a second strap, grasping each and rotating each in opposing directions, releasing the friction holding the closure on the article. The gripper is made from a sterilizable elastomeric material for use in a medical setting such as a hospital or a laboratory. The pair of identical straps are connected by a band attached to a middle portion on each strap. The gripper opens a connector on a central venous catheter (CVC) lumen, a pair of clasps on CVC stabilization device, a connector on a urine collection bag to a Foley catheter, and a cap on a laboratory sample vial as non-limiting examples.

10 Claims, 4 Drawing Sheets

GRIPPER FOR OPENING LUMEN AND VIAL CLOSURES

CROSS-REFERENCE TO RELATED APPLICATIONS

Not applicable.

BACKGROUND OF THE INVENTION

The invention relates generally to a gripper for opening a closure on a lumen or a vial. More particularly, the invention relates to a gripper having a pair of straps for safely opening a narrow cylindrical article, by wrapping a closure on a narrow cylindrical article with a first strap and wrapping the narrow cylindrical article with a second strap, grasping each and rotating each in opposing directions, releasing the friction holding the closure on the article.

In hospitals, doctors' offices, medical laboratories and many other medical and laboratory settings, workers often have to open relatively small closures on lumens and vials. Often these closures are encrusted with dried blood, precipitated salts, or other residues that make removing the closures very difficult. These closures, as well as the lumens and vials the closures are coupled with, are narrow in diameter. The worker can only apply finger tips to the closure when trying to open, resulting in a minimal amount of force being applied. Particularly when dealing with lumens that are attached to central venous lines or Foley catheters implanted in patients, the medical worker may not be able to get into a position that allows much torque to be applied.

In particular, central venous catheters, commonly referred to as "central lines," are placed into a large vein in the neck, chest or groin. They are used to administer medication or fluids, total parenteral nutrition, obtain blood tests, specifically the "mixed venous oxygen saturation," and directly obtain cardiovascular measurements such as the central venous pressure.

Usually central lines remain in place for a longer period of time than peripheral intravenous lines, especially when the reason for their use is longstanding, such as total parenteral nutrition in a chronically ill patient. Regular flushing with saline or a heparin-containing solution keeps the line clear and prevents thrombosis. When the central line is intended to stay in place for a long period of time, it is usually held in place by a suture or staple and an occlusive dressing. Many medical facilities have adopted a new technique, using a sterile securement device such as a StatLock® Stabilization Device (StatLock® is the registered trademark of C. R. Bard, Inc., Murray Hill, N.J.) to hold the central line in place by clasping the hub of the lines leading to the lumens. The sterile securement device must be changed minimally on weekly basis, which requires loosening the clasp of the device, presenting a similar problem of gripping a small diameter article and turning it to open.

In the laboratory, workers are confronted with numerous types of sample vials and vial closures, all with small diameters. Vials for lyophilization and freeze drying, serum vials, scintillation vials, auto-sampler vials, and venipuncture collection tubes are some of the many examples of small diameter vials used in laboratories. These vials may contain biological fluids, such as whole blood, plasma, and urine, hazardous materials such as organic solvents, or solutions of small amounts of rare materials. Similarly, the closures are often encrusted with dried biological fluids and precipitates. Unlike lumens on catheters, the vials may be either plastic or thin glass. Applying force to remove the closure to the vial often results in the glass shattering in the hand of the worker. The shattered glass has the potential of piercing gloves and cutting the worker, directly introducing hazardous or infectious materials into the worker's body. Even if the vial is plastic, applying excess force to the closure may result in the contents ejecting from the vial when the closure is released, releasing hazardous, infectious or precious materials into the environment.

Many solutions for removing closures that are difficult to release have been proposed. All involve a unitary strap around the article to be turned. All rely on the container or other part is held steady by the unaided hand of the user, or with a separate viselike holder. All solutions assume that the user can grasp the container in the hand if it is not held fixed by a separate tool and the user is not restricted to grasping the container only with the fingers.

While these units may be suitable for the particular purpose employed, or for general use, they would not be as suitable for the purposes of the present invention as disclosed hereafter.

SUMMARY OF THE INVENTION

It is an object of the invention to produce a gripper that is sterilizable for use in a medical or laboratory setting. Accordingly, the gripper is made from an elastomeric material that can be sterilized for use in a medical setting such as a hospital or a laboratory.

It is another object of the invention to produce a gripper that safely grasps a narrow cylindrical article while opening the article. Accordingly, the gripper has at least one strap that wraps around the narrow cylindrical article when opening the article.

It is a further object of the invention to produce a gripper that safely grasps a closure on a narrow cylindrical article and grasps the narrow cylindrical article, to rotate in opposing directions to release the friction holding the closure on the article. Accordingly, the gripper has a pair of straps, a first strap wrapping around the closure on the narrow cylindrical article and a second strap wrapping around the narrow cylindrical article, to rotate in opposing directions to release the friction holding the closure on the article.

It is yet another object of the invention to produce a gripper that safely grasps a connector on a central venous line catheter lumen and a cap on the connector, the cap and connector to rotate in opposing directions to remove the cap and access the luer connector. Accordingly, the gripper has a pair of straps, a first strap wrapping around the connector and a second strap wrapping around the cap, to rotate in opposing directions to release the cap from the connector.

It is yet a further object of the invention to produce a gripper for releasing a stabilization device for holding a hub of a central venous catheter on a patient's skin that protects a user's hands from a plurality of ridges on a pair of essentially cylindrical clasps locking the stabilization device on the hub. Accordingly, the gripper has a pair of straps, a first strap wrapping around a first clasp of the stabilization device and a second strap wrapping around a second clasp of the stabilization device that protects a user hands from the ridges on the clasps and allows a user to grasp the clasps firmly while rotating the clasps in opposing directions to release the hub.

It is still another object of the invention to produce a gripper for releasing a urine collection bag having a connector attached to a lumen on a Foley catheter. Accordingly, the gripper has a pair of straps, a first strap wrapping around the connector on the urine collection bag and a second strap wrapping around the lumen, to rotate the connector and the lumen in opposing directions to release the lumen from the connector.

It is still a further object of the invention to produce a gripper for safely opening a vial having a cap. Accordingly, the gripper has a pair of identical straps connected by a band, a first strap wrapping around the cap and a second strap wrapping around the vial, to rotate the cap and the vial in opposing directions without having to apply excessive torque shattering the vial.

The invention is a gripper having a pair of straps for safely opening a narrow cylindrical article, by wrapping a closure on a narrow cylindrical article with a first strap and wrapping the narrow cylindrical article with a second strap, grasping each and rotating each in opposing directions, releasing the friction holding the closure on the article. The gripper is made from a sterilizable elastomeric material for use in a medical setting such as a hospital or a laboratory. The pair of identical straps are connected by a band attached to a middle portion on each strap. The gripper opens a connector on a central venous catheter (CVC) lumen, a pair of clasps on CVC stabilization device, a connector on a urine collection bag to a Foley catheter, and a cap on a laboratory sample vial as non-limiting examples.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
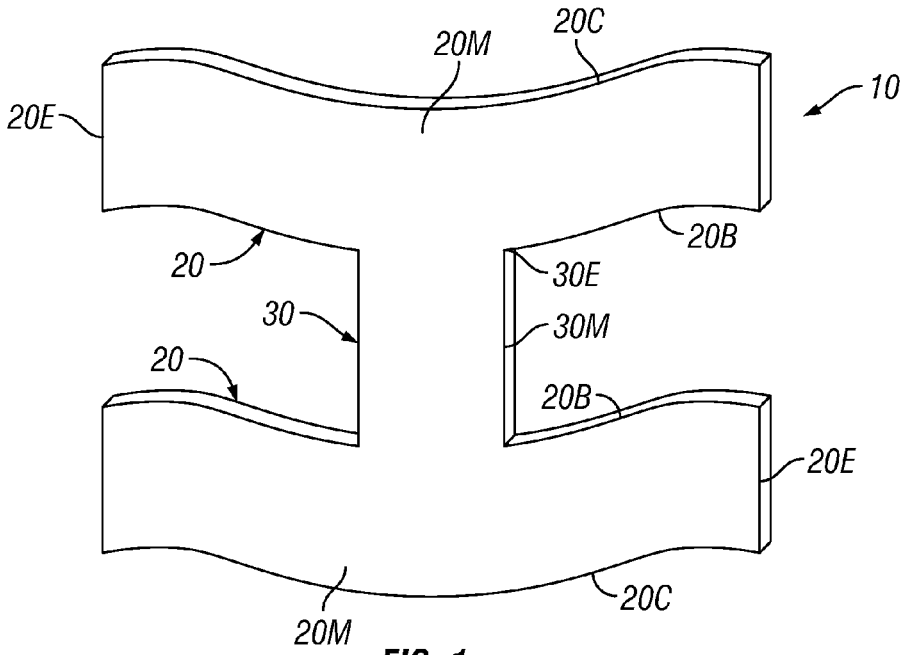
FIG. 1 is a diagrammatic perspective view of a gripper for opening a closure on a lumen or a vial.

FIG. 1 illustrates a gripper 10 for grasping a closure on a narrow cylindrical article having a small diameter in cross-section. The gripper 10 has a pair of straps 20 linked by a band 30. The cylindrical article has a pair of portions, typically a closure portion and a body portion. A first strap 20 is applied to the closure portion and a second strap 20 is applied to the body portion. The user, having a pair of hands, each with a plurality of fingers, grasps the strap 20 on the closure portion in the fingers of a first hand and grasps the strap 20 on the body portion in the fingers of a second hand. The gripper 10 allows the user to firmly grasp both portions of the article in order to apply torque to the closure. When the gripper 10 is applied wrapping the strap 20 around the closure portion or the body portion, the diameter of the closure portion or body portion is increased so that the torque applied by the user also is increased. The gripper 10 is made from an elastomeric material such as, for example, but not limited to, latex rubber and can be sterilized for use in a sterile environment.

The gripper 10 has the pair of identical straps 20, each strap 20 having a length, a plurality of edges having a thickness, a pair of ends 20E and a middle portion 20M located equidistant between the ends 20E. The gripper 10 has a connecting band 30 having a pair of ends 30E and a center 30M between the ends. Each strap 20 has an inside long edge 20B, facing towards the other strap 20 and an outside long edge 20C, facing away from the other strap 20. The ends 30E of the connecting band 30 are attached to the middle portion 20M of each strap 20, on the inside long edges 20B. The gripper 20 has a horizontal axis of symmetry, through the center 30M of the band 30 between the straps 20 and a vertical axis of symmetry through the middle portions 20M of the straps.

Figure 2:
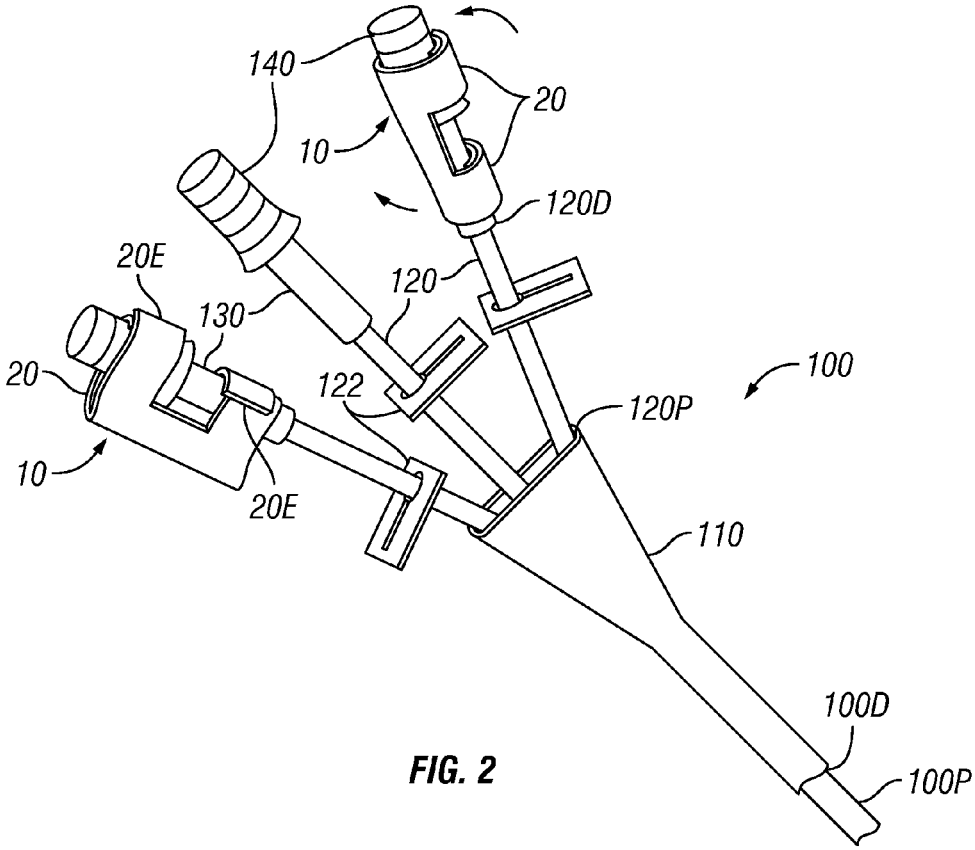
FIG. 2 is a diagrammatic perspective view of a triluminal central venous catheter with the gripper in place on a first lumen and the gripper in the process of wrapping on a second lumen.

FIG. 2 demonstrates the gripper 10 in use with a plurality of narrow cylindrical articles. In this illustration, the narrow cylindrical articles are lumens 120 of a central venous catheter (CVC) 100. The CVC 100 has a proximal end 100P inserted into the patient, a distal end 100D inserted into a hub 110 and a plurality of lumens 120, each lumen having a clamp 122, a proximal end 120P attached to the hub 110 and a distal end 120D extending away from the hub 110. Each distal end 120 has an luer connector 130, which is narrow and cylindrical having a narrow cross-section, and having a cap 140.

Figure 3:
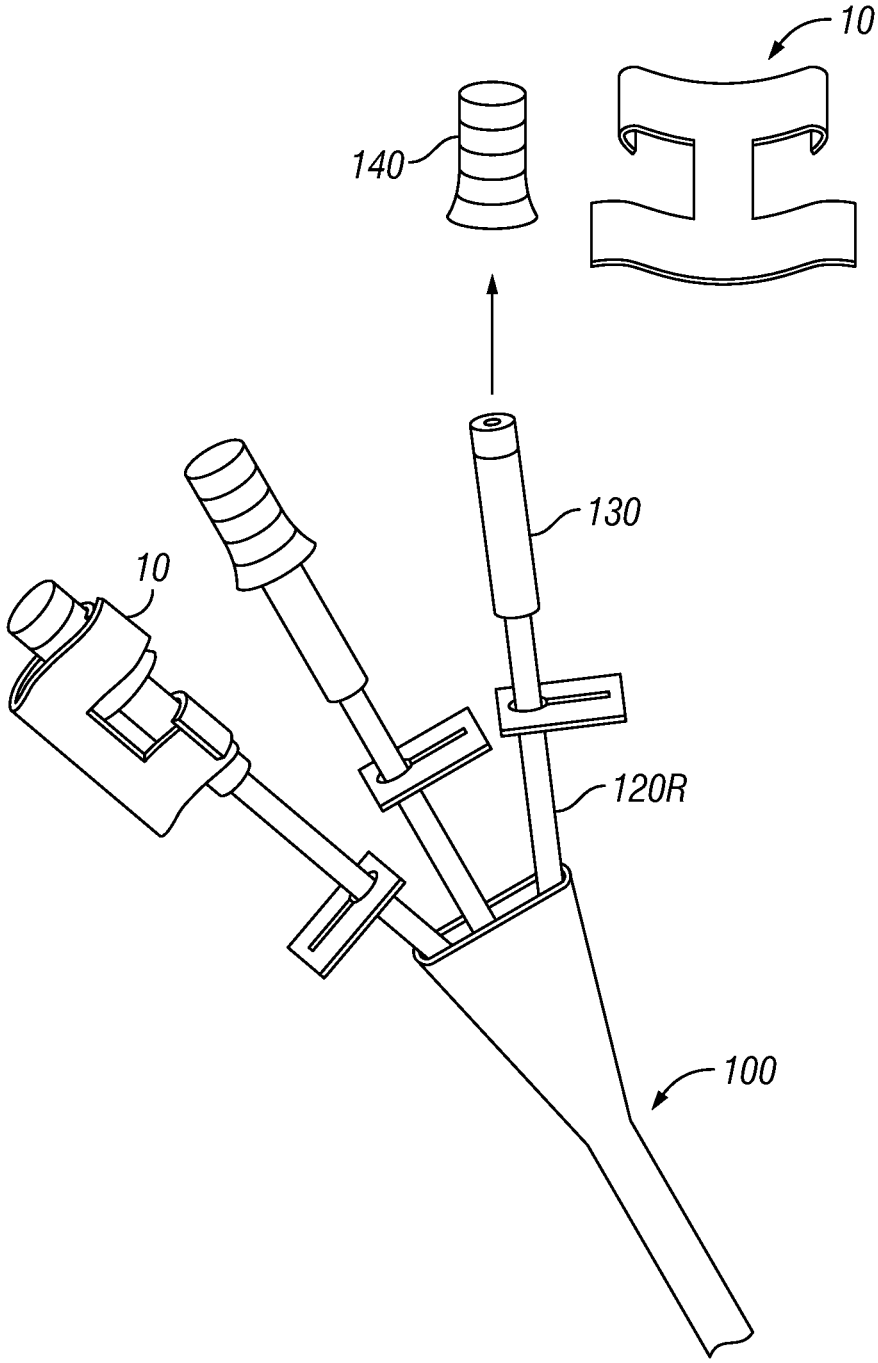
FIG. 3 is a diagrammatic perspective view of the triluminal central venous catheter with the closure on the first lumen removed and the gripper disengaged.

When a user wishes to introduce a medication, total parenteral nutrition (TPN), or monitor total venous pressure in one of the lumens 120, the user must access the luer connector 130. The user must remove the cap 140 by twisting the cap off, regardless of whether it is a snap-fit cap or a screw-on cap. The cap 140 is often covered with a crust of dried fluids, such as TPN, intravenous fluids or blood, making the task more difficult. The user wraps the first strap 20 around the cap 140 and the second strap 20 around the luer connector 130. The user overlaps the ends 20E of one strap 20 in a counterclockwise direction and the one strap 20 in a clockwise direction. The user twists one strap 20 in a clockwise direction, and one strap 20 in a counterclockwise direction to break the crust of dried fluid and to release the friction holding the cap 140 in place. FIG. 3 shows the cap 140 removed from the luer connector 130 on the right lumen 120R to allow access to the luer connector 130.

Figure 5:
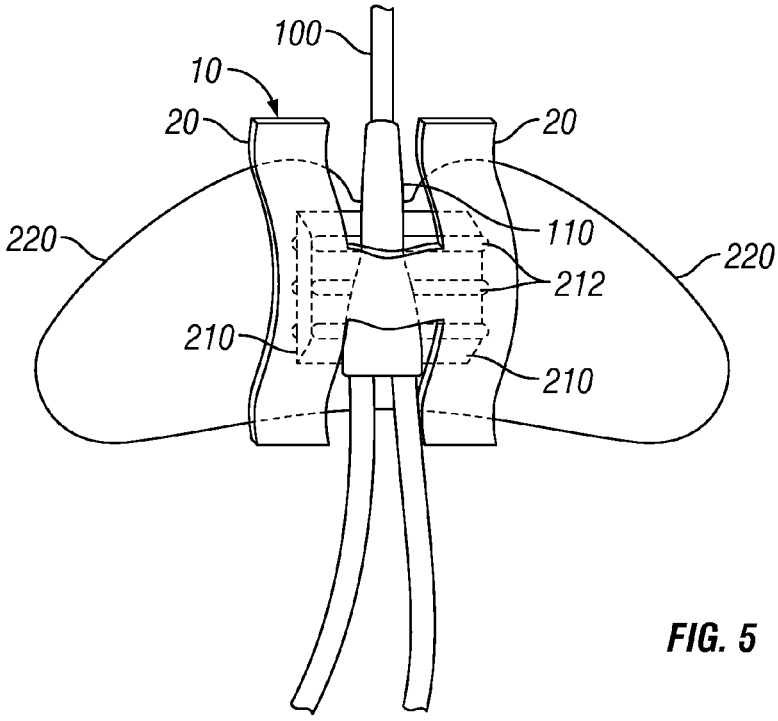
FIG. 5 is a diagrammatic perspective view of a Foley catheter with the gripper being applied to a lumen connecting the catheter to a urine collection bag.

FIG. 5 shows the hub of a CVC 100 held in place on a patient's skin by a StatLock® Stabilization Device 200 (StatLock® is the registered trademark of C. R. Bard, Inc., Murray Hill, N.J.) to hold the CVC in place by clasping the hub 110 of the lines leading to the lumens 120. Holding the hub 110 in place, shown in outline are a pair of clasps 210. The clasps 210 are short small diameter cylinders with a small circumference, arranged horizontally, one on each side of the hub 110. The operation of opening the clasps is analogous to opening the cap on a narrow cylindrical container, because the user is required to grasp a first portion such a cap or a first clasp, grasp a second portion such as a body or a second clasp, and rotate the first portion in a direction opposing the second portion. The clasps 210 have a plurality of horizontal ridges 212 on the circumference. The clasps 210 are attached to a pair of adhesive wings 220, one on each side of the hub 110. The wings 220 adhere to a patient's skin, stabilizing the hub 110 and the CVC line 100 inserted in the patient in place.

Analogously to opening the cap on the Luer connector, to release the hub 110, the first clasp 210 moves in a clockwise direction and the second clasp 210 moves in a counterclockwise direction. The clasps 210 often are cover with crusts of fluid and the ridges 212 cause discomfort to the user's fingers if a significant amount of force must be applied to open the clasps 210. Because the Statlock® 200 is attached to the patient, the clasps 210 must be rotated in place and cannot be maneuvered into a position where a user can apply more torque if necessary. The user places one strap 20 of the 10 gripper over a first clasp and one strap 20 of the gripper 10 over the second clasp to open the clasps. The gripper 10 protects the user's fingers from the ridges 212 of the clasps 210, allowing the user to apply sufficient torque in a painless manner to overcome the friction holding the clasps 210 in place on the hub 110.

Figure 6:
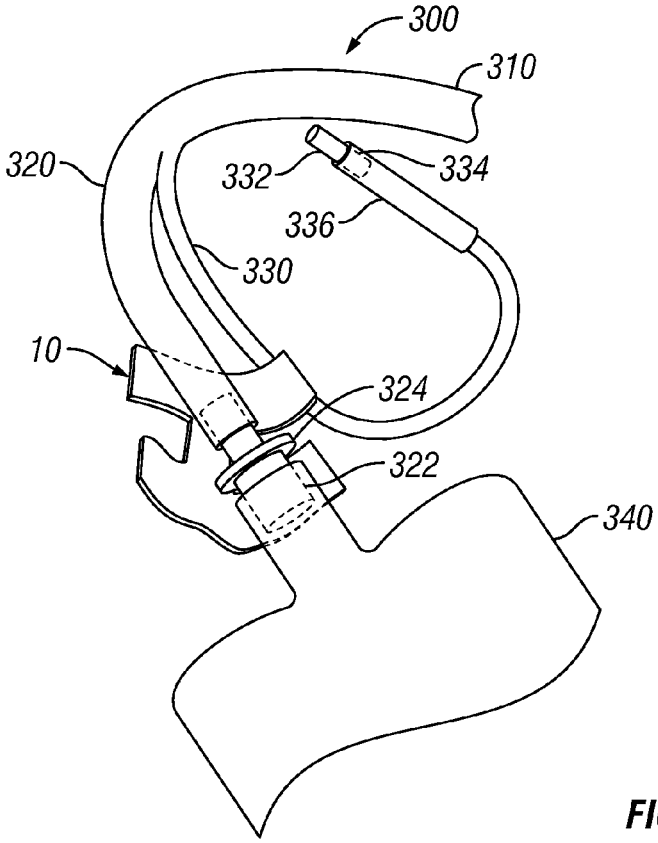
FIG. 6 is a diagrammatic perspective view of the gripper being applied to a catheter stabilization device.

FIG. 6 demonstrates the gripper 10 in use on a Foley catheter 300 for the collection of urine. The Foley catheter 300 has a lumen 310, having a proximal end 310 inserted into the urinary bladder and a distal end that bifurcates into a pair of lumens, a very narrow first lumen 330 and a wide second lumen 320 that is attached by a connector 322 to a urine collection bag 340. The very narrow lumen 330 has an opening 334 with a cap 332 for the introduction of sterile water into the catheter 300 to inflate a balloon inside the bladder that keeps the catheter in place. The urine collection bag 340 on the wide lumen 320 is removed frequently for emptying, generally several times a day. The connector 322 has a locking device 324 that must be twisted or unscrewed to remove the urine collection bag 340 for emptying. Dried urine, which has a high salt content often covers the connector 322 making removal of the bag 340 difficult. One strap 20 of the gripper 10 is placed over the wide lumen 320 and one strap 20 over the connector 322 and rotated in opposing directions to overcome the friction holding the connector 322 to the bag 340. The second smaller lumen 330 is tightly capped between balloon inflations with a luer connector 336 in the opening 334 to prevent bacteria from entering the bladder. Because the smaller lumen 330 is tightly closed, removing the cap 332 is difficult. The user places one strap of the gripper around the cap and one strap around the luer connector 336 to twist the cap 332 off.

Figure 4:
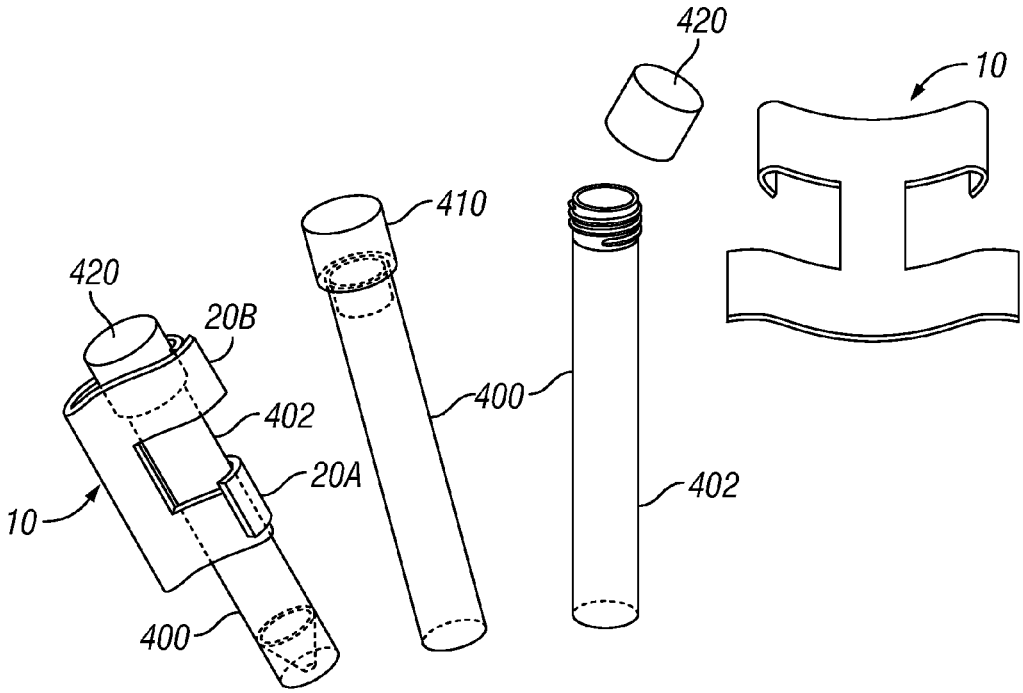
FIG. 4 is a diagrammatic perspective view of a plurality of different types of sample vials, each with a different style of closure, with the gripper in the process of placement on a first vial and the closure on a second vial removed and the gripper disengaged.

FIG. 4 demonstrates another application of the gripper 10. Laboratories use small narrow diameter vials 400 that are closed with a stopper 410 or screw cap 420, such as for example, but not limited to, lyophilization vials, venipuncture collection tubes and sample vials. The vials 400 have a body portion 402 that is generally fragile glass that shatters when too much torque is applied when removing the closure. The first strap 20A is wrapped around the body portion 402 and the second strap 20B is wrapped around the cap 420. The cap 420 and the body portion 402 are twisted in opposing directions to remove the cap 420. The gripper may be applied in the same manner to tighten the screw cap to achieve a better seal.

In conclusion, herein is presented a gripper having a pair of straps for safely opening a narrow cylindrical article, by wrapping a closure on a narrow cylindrical article with a first strap and wrapping the narrow cylindrical article with a second strap, grasping each and rotating each in opposing directions, releasing the friction holding the closure on the article. The invention is illustrated by example in the drawing figures, and throughout the written description. It should be understood that numerous variations are possible, while adhering to the inventive concept. Such variations are contemplated as being a part of the present invention.

What is claimed is:

1. A gripper for opening a closure on a narrow cylindrical article, comprising:

a pair of straps, a first strap and a second strap, each strap having a pair of ends and a long inside edge with a middle portion located equidistant between the ends; and a band, having a pair of ends, a first end attached to the middle portion of the long inside edge of the first strap and a second end attached to the long inside edge of the second strap, connecting the first strap to the second strap, wherein the first strap is applied operative for maintaining a grip on the narrow cylindrical article and the second strap is applied operative for maintaining a grip on the closure so that the narrow cylindrical article and the closure can be rotated in opposing directions.

2. The gripper as described in claim 1 wherein the band has a center equidistant between the ends and the gripper has a horizontal axis of symmetry through the center of the band.

3. The gripper as described in claim 2 wherein the gripper has a vertical axis of symmetry equidistant between the inside long edges of the band.

4. A gripper for opening a closure on a narrow cylindrical article, comprising:

a pair of straps, a first strap and a second strap, each strap having a pair of ends and a long inside edge with a middle portion located equidistant between the ends;

a band, the band having a pair of ends, a first end attached to the middle portion of the long inside edge of the first strap and a second end attached to the middle portion of the long inside edge of the second strap, connecting the first strap to the second strap, the band further having a center equidistant between the ends; and a pair of axes of symmetry, a horizontal axis through the center of the band and a vertical axis equidistant between the long inside edges of the straps, wherein the first strap is applied parallel to the horizontal axis to grip the narrow cylindrical article and the second strap is applied parallel to the horizontal axis to grip the closure so that the narrow cylindrical article and the closure can be rotated in opposing directions.

5. A method of using a gripper for opening a closure on a narrow cylindrical article, the gripper having a pair of straps, a first strap and a second strap, each strap having a pair of ends and a long inside edge with a middle portion located equidistant between the ends, and a band, having a pair of ends, a first end attached to the middle of the long inside edge of the first strap and a second end attached to the long inside edge of the second strap, connecting the first strap to the second strap, comprising:

wrapping a first strap around the closure and a second strap around the narrow cylindrical article, grasping and rotating the closure enrapped with the first strap in a direction and the narrow cylindrical article in an opposing direction; and opening the closure by releasing the friction holding the closure in place.

6. The method of using a gripper for opening a closure on a narrow cylindrical article as described in claim 5, wherein the narrow cylindrical article is a luer connector on a lumen of a central venous catheter and the closure is a cap.

7. The method of using a gripper for opening a closure on a narrow cylindrical article as described in claim 5, wherein the narrow cylindrical article is a first clasp on a catheter stabilization device and the closure is a second clasp on a catheter stabilization device.

8. The method of using a gripper for opening a closure on a narrow cylindrical article as described in claim 5, wherein the narrow cylindrical article is a vial.

9. The method of using a gripper for opening a closure on a narrow cylindrical article as described in claim 5, wherein the narrow cylindrical article is a luer connector on a lumen for inflating a balloon of a Foley catheter and the closure is a cap.

10. The method of using a gripper for opening a closure on a narrow cylindrical article as described in claim 5, wherein the narrow cylindrical article is a lumen on the Foley catheter and the closure is a connector to a urine collection bag.

* * * * *